US005417598A

United States Patent [19]

Stauffer

[11] Patent Number: 5,417,598

[45] Date of Patent: May 23, 1995

[54] INFLATABLE PADDLE WHEEL LIFE SAVING DEVICE

[76] Inventor: Kenneth R. Stauffer, 609 Crestwood Ave., Wadsworth, Ohio 44281-1930

[21] Appl. No.: 271,968

[22] Filed: Jul. 8, 1994

[51] Int. Cl.[6] ..... B63H 1/38

[52] U.S. Cl. ..... 440/100

[58] Field of Search ..... 441/92, 95; 440/76, 440/78, 95, 96, 97, 98, 99, 100

[56] References Cited

U.S. PATENT DOCUMENTS

| | | | |
|---|---|---|---|
| 1,777,749 | 10/1930 | Eguiluz | 440/100 |
| 2,416,471 | 2/1947 | Chappedelaine | 440/100 |
| 3,046,576 | 7/1962 | Bernhardt | 441/92 |
| 3,516,381 | 6/1970 | Bobbitt | 441/78 |
| 3,630,413 | 12/1971 | Beckes | 441/95 |
| 4,154,188 | 5/1979 | Flagg | 440/100 |

*Primary Examiner*—Stephen P. Avila

[57] ABSTRACT

A life saving device which permits controlled movement by a user through the water comprising a pair of inflatable tubular paddle wheels having a plurality of rigid bars connecting the wheels. A person lying on his back and pulling down on each successive bar causes the wheels to rotate while paddles on the wheels then cause the unit to move through the water pulling the operator with it. The unit may be carried in its deflated state on the person or stowed in a boat as are present day life jackets or the like.

4 Claims, 4 Drawing Sheets

FIG 3
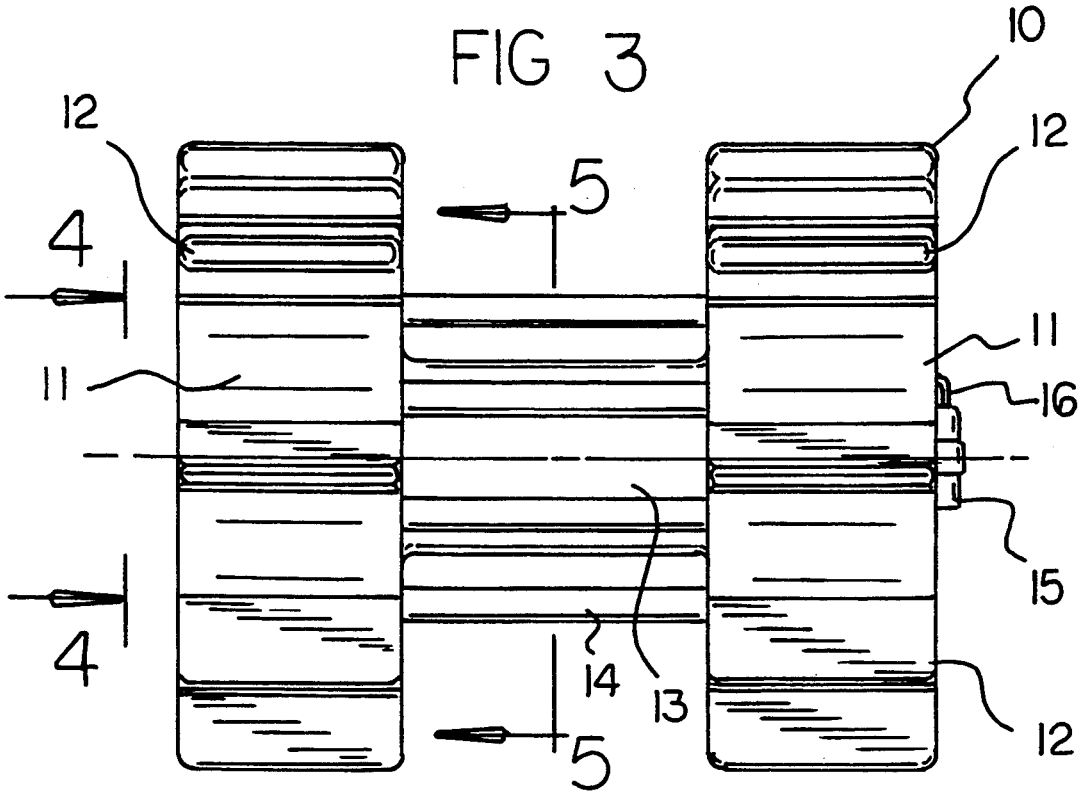
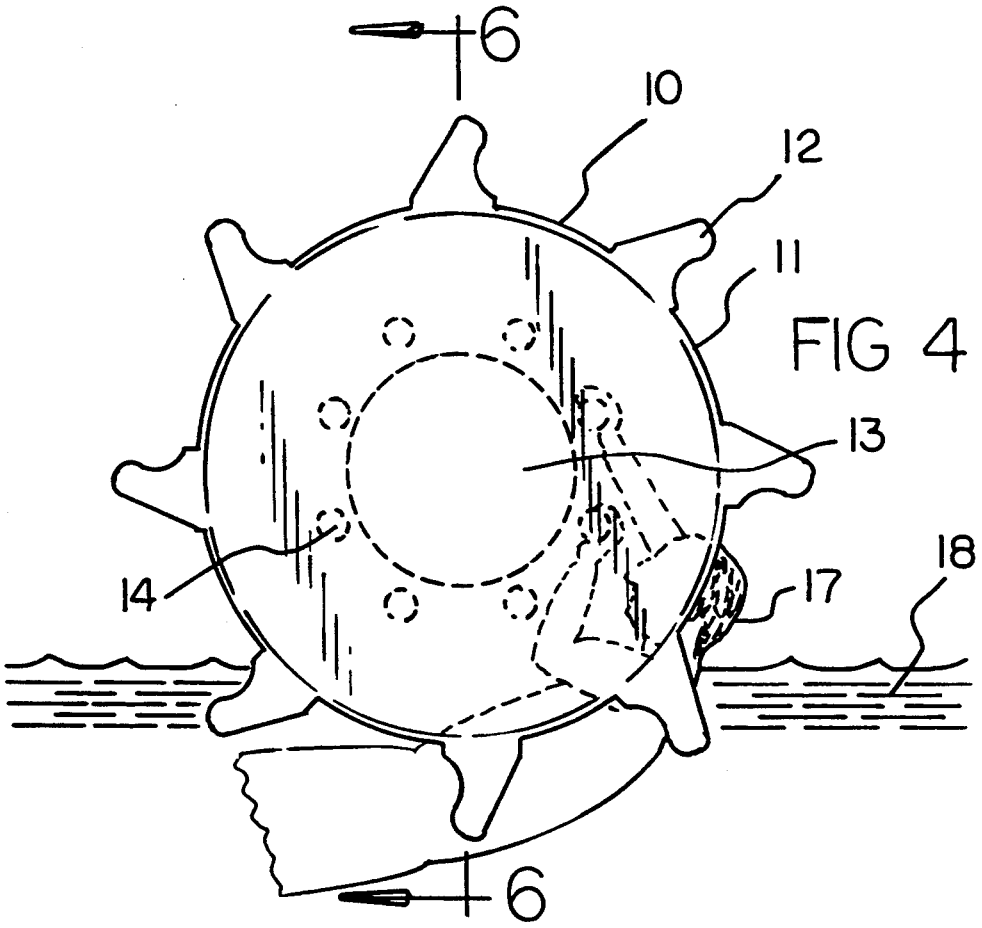
FIG 4

INFLATABLE PADDLE WHEEL LIFE SAVING DEVICE

BACKGROUND OF THE INVENTION

1. Field of the Invention

The present invention relates to life saving devices and more particularly pertains to such a device utilizing paddle wheels to permit positive motion in a desired direction.

2. Description of the Prior Art

The use of inflatable manually-powered paddle wheels or equivalents thereof is known in the prior art. More specifically, such devices have been heretofore devised and utilized for the purpose primarily of entertainment and are known to consist basically of familiar, expected and obvious structural configurations, generally carrying a person on top of or within the buoyant structure, notwithstanding the myriad of designs encompassed by the crowded prior art which have been developed for the fulfillment of countless objectives and requirements. Typical of such devices are those illustrated in U.S. Pat. Nos. 3,934,291 and 3,779,201 (drawings from which are reproduced as FIGS. 1 and 2 herein); 4,154,188; 3,664,290; and 4,379,701.

In this respect, the device according to the present invention substantially departs from the conventional concepts and designs of the prior art in that the user remains in the water external to the device. In so doing the present invention provides an apparatus primarily developed for the purpose of being a life saving device which contrary to life rings or like static units, permits positive directional motion which can help carry a victim to safety.

Therefore, it can be appreciated that there exists a continuing need for new and improved life saving device which can be positively moved by the user. In this regard, the present invention substantially fulfills this need.

SUMMARY OF THE INVENTION

In view of the foregoing disadvantages inherent in the known types of personal life saving devices now present in the prior art, the present invention provides an improved construction wherein the same can be utilized to transport a person under manual power while immersed in a body of water. As such, the general purpose of the present invention, which will be described subsequently in greater detail, is to provide a new and improved life saving apparatus which has all the advantages of the prior art devices and none of the disadvantages.

To attain this, the present invention essentially relates to a life saving device which permits controlled movement by a user through the water comprising a pair of inflatable tubular paddle wheels having a plurality of rigid bars connecting the wheels. A person lying on his back and pulling down on each successive bar causes the wheels to rotate while paddles on the wheels then cause the unit to move through the water pulling the operator with it. The unit may be carried in its deflated state on the person or stowed in a boat as are present day life jackets or the like.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved life saving device which has all the advantages of the prior art devices and none of the disadvantages.

It is another object of the present invention to provide a new and improved inflatable paddle wheel life saving device which may be easily and efficiently manufactured and marketed.

It is a further object of the present invention to provide a new and improved inflatable paddle wheel device which is of a durable and reliable construction.

An even further object of the present invention is to provide a new and improved inflatable paddle wheel device which is susceptible of a low cost of manufacture with regard to both materials and labor, and which accordingly is then susceptible of low prices of sale to the consuming public, thereby making such devices economically available to the buying public.

Still yet another object of the present invention is to provide a new and improved life saving device which provides in the apparatuses and methods of the prior art some of the advantages thereof, while simultaneously overcoming some of the disadvantages normally associated therewith.

Still another object of the present invention is to provide a new and improved manually-powered life saving device.

Yet another object of the present invention is to provide a new and improved inflatable paddle wheel device capable of manually moving a swimmer through the water.

Even still another object of the present invention is to provide a new and improved inflatable paddle wheel life saving device which may be stowed or carried on the person when in its deflated state.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front plan view of the device of the present invention.

FIG. 4 is a side elevation view of such device showing it in use with a swimmer in the water.

DESCRIPTION OF THE PREFERRED EMBODIMENT

Figure 1:
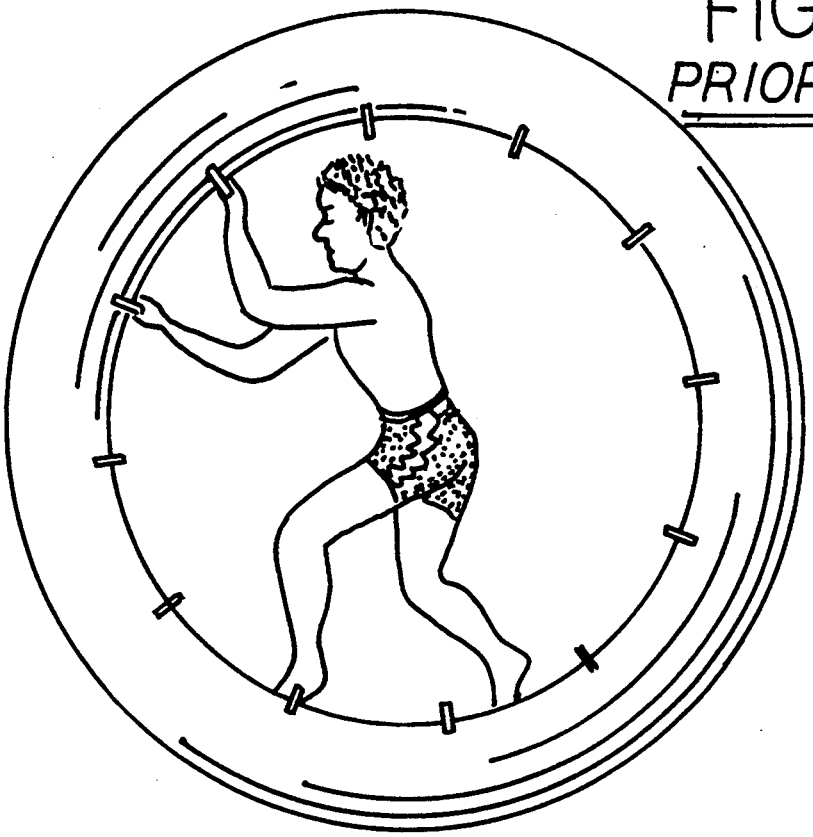
FIG 1 PRIOR ART
FIGS. 1 and 2 illustrate two types of buoyant structures from the prior art adapted to support a person therein and to be moved manually through the water.
Figure 2:
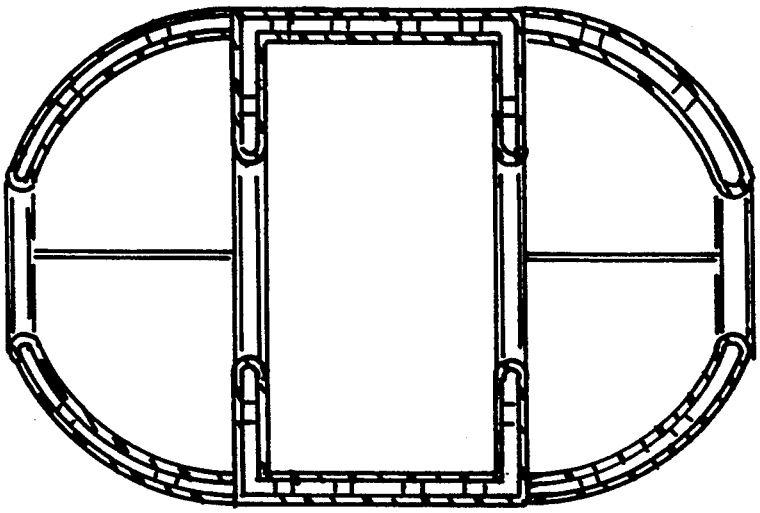
FIG 2 PRIOR ART

FIGS. 1 and 2 illustrate prior art devices intended for amusement rather than life saving but comprising buoyant structure capable of being manually propelled through the supporting water. In these devices, the user is supported on or within the structure and impetus to the structure is provided by the user's feet (much like a treadmill).

In contrast and with reference now to FIG. 3 of the drawings, a new and improved inflatable paddle wheel life saving device embodying the principles and concepts of the present invention and generally designated by the reference numeral 10 will be described.

More specifically, it will be noted that in its inflated state, device 10 comprises a pair of hollow wheel-shaped members 11 bearing on their external surfaces a plurality of extending hollow paddle members 12 forming a unitary structure internally communicating with wheel members 11. Wheel members 11 are pneumatically interconnected by a hollow axle 13 also in internal communication with the interiors of wheel members 11. Also providing a connection between wheel members 11, but in this case a connection with the external surfaces thereof, are a plurality of rigid cylindrical rods 14 extending between wheel members 11 parallel to and in a surrounding relationship to the hollow axle 13. Affixed to an external surface of at least one of the wheel members 11 and in communication with the interior thereof (and hence with the interior of the rest of the structure 10 excepting rods 14) is a container 15 which, prior to inflation, provides a source of an expandable inflating gaseous medium, e.g. $CO_2$. Using a conventional valve (not shown) on such cylinder 15, the inflating gas can be released to enter the structure 10 through suitable tubing shown at 16.

Figure 5:
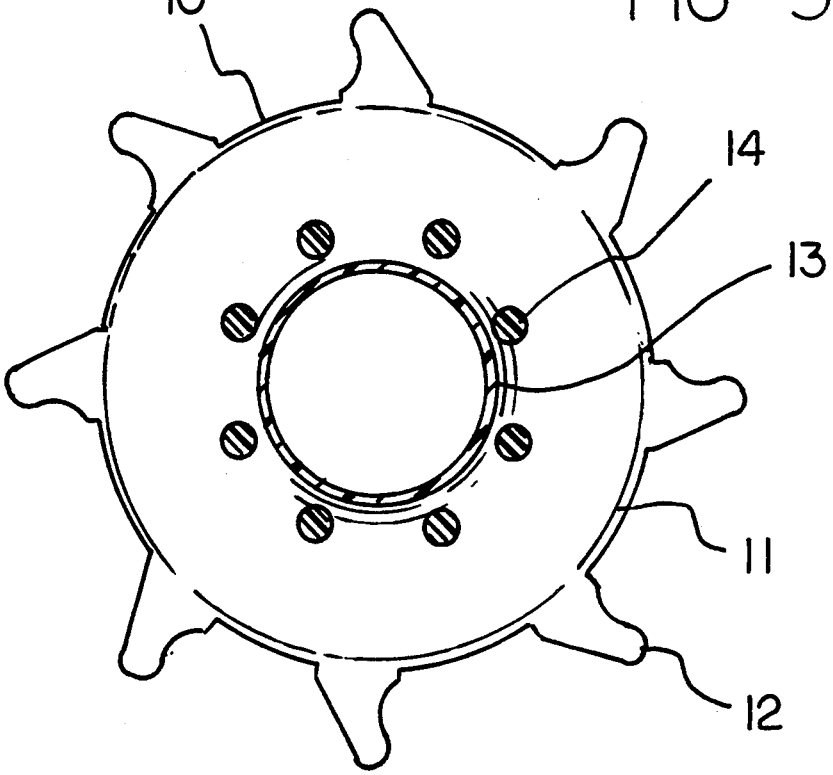
FIG. 5 is a sectional view of the device of FIG. 3 taken on line 5—5 of FIG. 3.

In use, the device 10, as illustrated in FIG. 4, is powered by a swimmer or person 17 in the water 18. The user 17 positions himself in the water below and between the wheel members 11 and reaches up to progressively engage each cylindrical rod 14, pulling down on such rod as if climbing a ladder. As each successive rod 14 is pulled down, rotation is imparted to wheel members 11. During such rotation, paddle members 12 engage with the water impelling the device into motion over the water surface and dragging the user along with it. The impelling rods 14 are more clearly shown in the sectional view of FIG. 5 as is the hollow axle 13.

Figure 6:
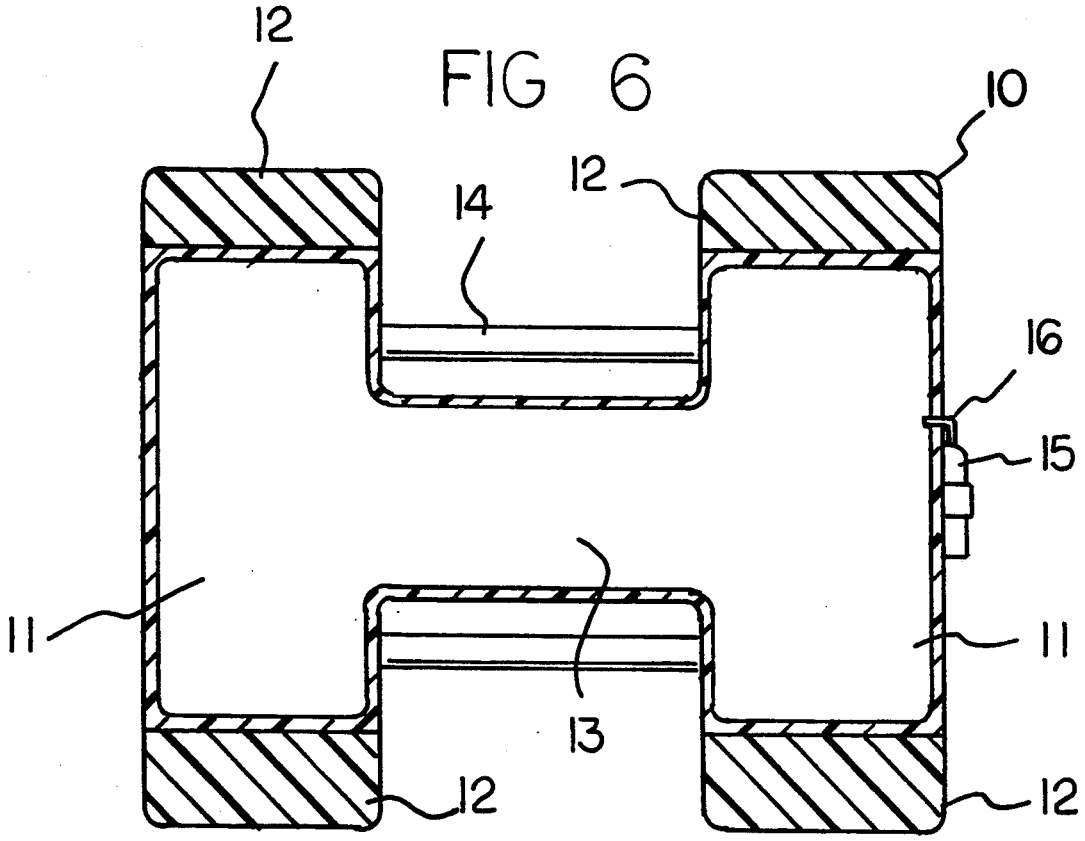
FIG. 6 is a sectional view taken on line 6—6 of FIG. 4.

FIG. 6 shows the communication internally of device 10 starting with the tubing 16 from the gaseous medium container 15 into wheel member 11 and its corresponding paddle members 12, thence to hollow axle member 13 and to the second wheel 11 and paddles 12. Rods 14 are clearly shown to be external to the inflatable portions of device 10 and to be anchored to and between wheel members 11.

Figure 7:
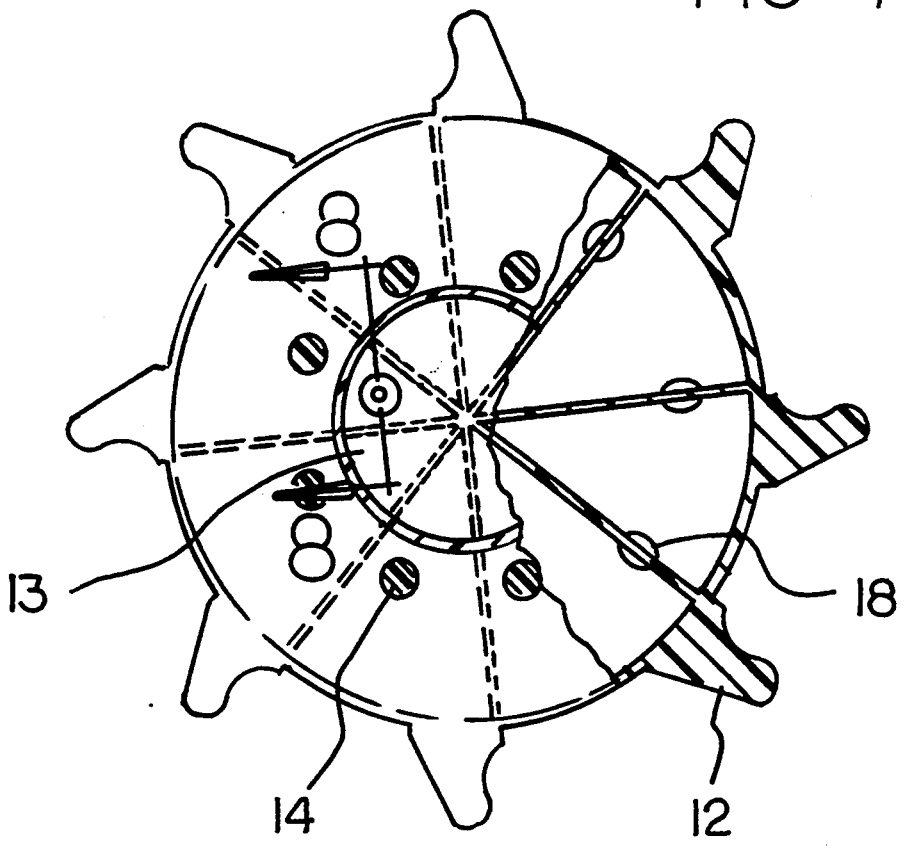
FIG. 7 is a partially sectional side plan view of a modification of the device in FIG. 3.
Figure 8:
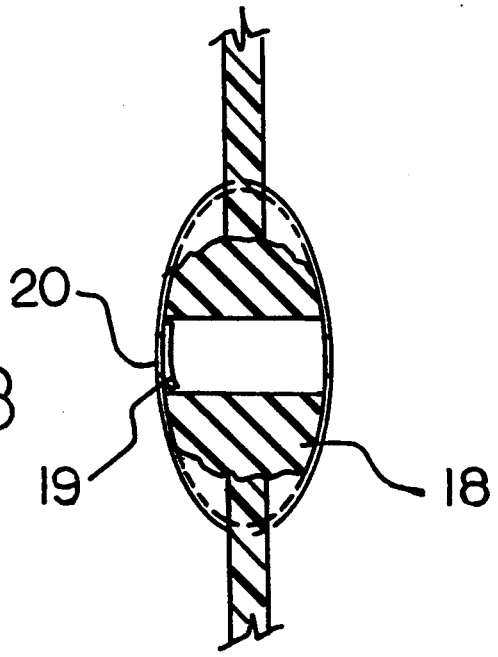
FIG. 8 is a sectional view on line 8—8 of FIG. 7.

FIGS. 7 and 8 illustrate a variation of device 10 in that while all chambers are still in communication one with the other for introduction of the inflating gaseous medium, each wheel member 11 is divided into a plurality of annular chambers 17. A simple flap type valve 18 in each chamber 17 (shown clearly in FIG. 8) allows incoming inflatable gas to enter each chamber 17 but not to return since valve flap 19 is then forced against its seat 20. This allows one or more chambers 17 to receive damage while still retaining buoyancy for the device 10 as a whole.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved personal life saving device which comprise: a pair of spaced and pneumatically intercommunicating hollow inflatable tubular wheels; a plurality of paddle members projecting from the surfaces of said wheels; a means for supplying a gaseous inflating medium to the interior of said intercommunicating wheels; and a plurality of rigid cylindrical bars anchored to and between said pair of wheel whereby downward pressure of each bar successively will cause said wheels to rotate and the paddles thereon to move the device, thereby, dragging the user thereof through the water supporting said wheels, the interior of said wheels are internally connected to each other by a hollow axle affixed to and pneumatically interconnecting said wheels, said cylindrical bars are arranged in a surrounding relationship to said hollow axle.

2. A device as in claim 1 wherein each of said wheels is internally divided into a plurality of annular chambers; and a one-way valve in each of said chambers communicates only with the immediately preceding chambers.

3. A device as in claim 1 wherein said means for supplying a gaseous inflating medium comprises a single valve-controlled cylinder of a pressurized gaseous medium and tubing connecting said cylinder to the interior of at least one of said wheels.

4. A device as in claim 3 wherein said gaseous medium is carbon dioxide.

* * * * *